United States Patent [19]

Holmström et al.

[11] Patent Number: 4,820,892

[45] Date of Patent: Apr. 11, 1989

[54] HEATING ARRANGEMENT FOR PACKING CONTAINERS HOLDING LIQUID CONTENTS

[75] Inventors: Gert Holmström, Lund; Paul Mellbin, Bara, both of Sweden

[73] Assignee: Tetra Pak International AB, Lund, Sweden

[21] Appl. No.: 169,140

[22] Filed: Mar. 10, 1988

Related U.S. Application Data

[63] Continuation of Ser. No. 893,203, Aug. 5, 1986, abandoned.

[30] Foreign Application Priority Data

Aug. 22, 1985 [SE] Sweden ..... 8503912

[51] Int. Cl.[4] ..... H05B 6/12

[52] U.S. Cl. ..... 219/10.491; 219/10.69; 219/10.65; 219/10.79

[58] Field of Search ..... 219/10.79, 10.49 R, 219/10.51, 10.71, 10.57, 10.69, 10.81, 10.65, 10.43, 10.55 R, 10.55 E, 10.55 F, 10.491; 99/DIG. 14, 451; 126/390; 336/223, 224, 222

[56] References Cited

U.S. PATENT DOCUMENTS

| | | | |
|---|---|---|---|
| 3,114,626 | 12/1963 | Dombrowski et al. | 219/10.65 X |
| 3,394,007 | 7/1968 | Campbell | 219/10.81 X |
| 3,427,422 | 2/1969 | Muller | 219/10.55 X |
| 3,725,629 | 4/1973 | Vickers | 219/10.79 |
| 3,737,608 | 6/1973 | Nagao et al. | 219/10.55 R |
| 3,786,222 | 1/1974 | Harnden, Jr. et al. | 219/10.49 R |
| 3,790,735 | 2/1974 | Peters, Jr. | 219/10.49 R |
| 3,804,968 | 4/1974 | Mosser | 219/10.49 X |
| 3,827,275 | 8/1974 | Suttan et al. | 219/10.79 X |
| 3,843,857 | 10/1974 | Cunningham | 219/10.79 X |
| 4,020,310 | 4/1977 | Souder, Jr. et al. | 219/10.49 R |
| 4,430,543 | 2/1984 | Olofsson | 219/10.79 |
| 4,453,067 | 6/1984 | Karkyls et al. | 219/10.79 X |
| 4,687,894 | 8/1987 | Koga et al. | 219/10.43 |

FOREIGN PATENT DOCUMENTS

| | | |
|---|---|---|
| 2806825 | 8/1979 | Fed. Rep. of Germany . |
| 2806824 | 8/1979 | Fed. Rep. of Germany . |

*Primary Examiner*—Philip H. Leung

*Attorney, Agent, or Firm*—Burns, Doane, Swecker & Mathis

[57] ABSTRACT

The invention relates to a heating arrangement for packing containers (5) which hold a liquid beverage. The heating arrangement functions in such a manner that induction currents are induced in an aluminium foil layer which is laminated into the packing material at the same time as a mechanical movement is imparted to the packing container (5) in order to bring about a circulation of the beverage. The induction currents are produced with the help of an inductor (1, 7, 10) which subjects selected, jointless parts of the packing container to a high-frequency electromagnetic field.

5 Claims, 5 Drawing Sheets

HEATING ARRANGEMENT FOR PACKING CONTAINERS HOLDING LIQUID CONTENTS

This application is a continuation of application Ser. No. 06/893,203, filed Aug. 5, 1986, now abandoned

FIELD OF THE INVENTION

The present invention relates generally to heaters, and specifically to a heating arrangement for heating packing containers holding liquid contents.

BACKGROUND OF THE INVENTION

Beverages which customarily are consumed in heated condition, such as e.g. coffee, tea, drinking chocolate and the like are sometimes packed ready-made in non-returnable packages of the type sold occasionally in vending machines. It is desirable that such beverages should be made available heated for immediate consumption after the purchase, which means that the beverage must be heated before delivery from the vending machine. Heated beverages of the type referred to here are being supplied already in vending machines, but the packages which contain the beverages must be stored in these cases in a heated space in the vending machine. This means that the beverage is stored in heated condition during a long time which in most cases causes a deterioration of the taste and quality of the beverage. Hence there is a need for a vending machine where the beverage is heated at the instant when it is sold, but where the beverage in its package is stored unheated in the vending machine up to the instant of its sale. A solution of this problem is provided by the present invention whose characteristics are evident from the enclosed claims.

BRIEF DESCRIPTION OF THE DRAWING

In the following the invention will be described with reference to the attached schematic drawing wherein.

DETAILED DESCRIPTION OF THE PREFERRED EMBODIMENT

Figure 1:
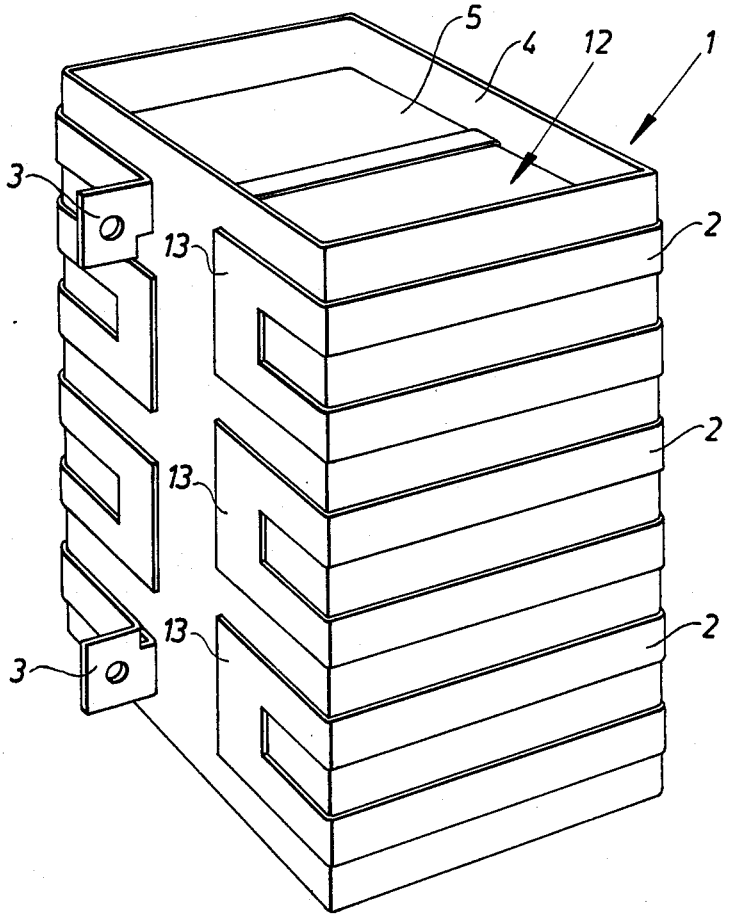
FIG. 1 is a perspective view of a heating arrangement designed to surround the package and manufactured from coherent U-shaped elements.

It is assumed that the packing container 5 which contains the beverage is of the type which comprises at least one layer of metal foil, preferably aluminum foil. The package 5 can be manufactured either from a prefabricated and precreased blank or it can be manufactured from a continuous web of packing material which is successively formed to a tube which is filled with contents and divided into individual packing units through sealing of the tube and shaping of the sealed and separated tube portions filled with contents. Generally a package of the type referred to here is provided with a longitudinal overlap joint 6 where two material edges overlap each other and likewise, in those cases where the packages are of parallelepipedic shape, it is customary for the shaping to take place in such a manner that opposite short sides have sealing fins where the packing material is sealed inside to inside, and that at each of the four corners of the package triangular double-walled lugs are formed which are folded down and sealed to the side walls or bottom of the package. Beside the aluminum foil layer the packing material generally comprises a base layer of paper or cardboard and inner and outer layers of thermoplastic material which on the one hand serve for providing the package with a liquid-tight inside and on the other hand function as sealants, in that thermoplastic layers placed against each other with the help of heat and pressure can be made to melt together in a tight and durable sealing joint.

Since the beverage in its packing container is to be supplied heated at the instant of its sale the heating has to be done relatively rapidly and consumer research has revealed that the heating time must not exceed 45 seconds for volumes of approx. one quarter litre. In this time the beverage is to be heated from a temperature of approx. 20° C. to 55°-60° C. which is considered a normal consuming temperature for warm drinks.

The heating should be done in such a manner, moreover, that there is no effect upon the taste, and the heating should be homogeneous so that no local overheatings of the beverage or parts of the package occur. The heating is done in such a manner in accordance with the invention that induction currents are generated in the aluminum foil layer of the package from which the heat is conducted to the beverage. In order to obtain the quickest possible heating effect the largest possible parts of the aluminum foil layer in the wall surface of the packing container should participate in the heat generation, but it has been found that there are certain limitations and certain regions of the package where heat generation may not take place. Such a region is e.g. the said longitudinal joint 6 where two edges of the packing material are combined with each other. Other such zones are the triangular double-walled lugs and the sealing fins located on the end surfaces of the package (in FIG. 4 the surfaces which may not be subjected to induction currents are marked by hatching). The reason why these wall surfaces cannot participate in the heat generation is that currents induced in the edge regions where the aluminum foil layer ends (e.g. along the said longitudinal joint) cause constrictions of the path of the current which brings about a local overheating which can become so strong that the aluminum foil layer along the edge zone is made to glow and that charring of the paper and plastics takes place with the accompanying risk of leakage or at least a strong effect upon the taste of the product. Hence the heat-generating induction currents must be located solely on "open" jointless surfaces of the package walls, and the problem can be solved through various designs of the induction coils 2.

In the present case three different types of induction coils, their advantages and disadvantages and their practical applicability, are discussed.

Figure 1A:
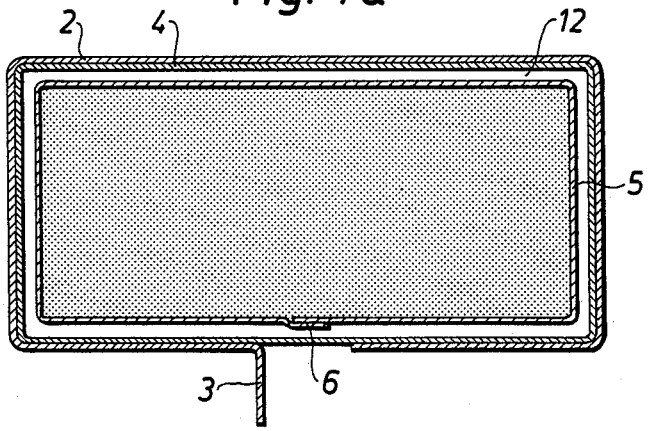
FIG. 1*a* is a sectional view of the arrangement according to FIg. 1.
Figure 5:
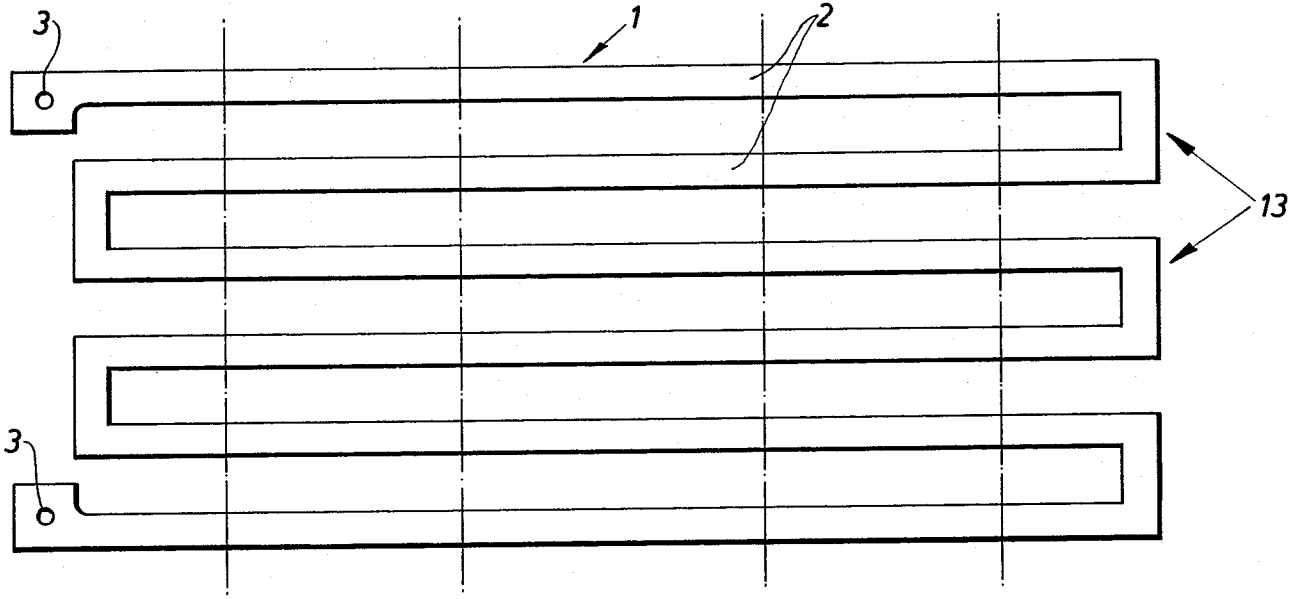
FIG. 5 is a plan view of an inductor formed of U-shaped elements expanded in a plane.

The inductor shown in FIG. 1 is made up of a coil 2 which in expanded condition is shown in FIG. 5. The inductor or coil 1 which is punched out of a sheet, preferably of copper, comprises a number of coil turns 2, each being constituted of a series of U-shaped elements 13 coupled together whose end points constitute the connecting contacts to a power source which provides a high-frequency current (a typical value is 200 kHz). By winding the punched out coil in accordance with FIG. 5 (the dash-dotted lines) a shape in accordance with FIG. 1 is imparted to the same, a so-called inductor space 12 being formed, and it may be appropriate to fix the coil on the outside of a shell or bobbin 4 of insulating material to facilitate thereby the introduction and the passage through the inductor 1 of the package 5. In FIG. 1*a* is shown schematically a section through the inductor in accordance with FIG. 1, and as can be seen the overlap joint 6 of the package 5 is located outside the region where the inductor 1 produces any electromagnetic field which generates induction currents in the aluminium foil layer of the package.

The heating takes place so that the package 5, by means of devices not shown here, is fed into the inductor space 12 of the inductor 1 by being introduced into the shell 4 of the inductor 1 whereupon the inductor 1 is connected to a power source via the contacts 3. The electromagnetic field generated in the coil turns 2 will induce electric currents in the aluminium foil layer of the package whilst the longitudinal joint 6 of the package is located in such a manner that no induction currents will occur in the joint region. Similarly no currents are induced in the top and bottom region of the package 5 whereas induction currents are in fact induced in the sidewalls of the package 5 which represent jointless regions. Measurements which were carried out after the package had been introduced into the inductor space 12 show that at a power input from the generator of 1150 Watt the temperature in the top layer of the package 5 was 89° C. whilst in the bottom layer the temperature was only 47° C., these temperatures being measured after a time of 46 seconds from the moment when the current had been switched on. This uneven heat distribution in the package is unacceptable, since the temperature in the upper part of the package substantially exceeds the temperature that is desired and that may be attained without deterioration of the taste of the product whereas the heating of the lower part of the package does not come up to the desired consumption temperature. Displacements of the coil turns so as to produce an asymmetric arrangement did not bring about any major improvement whereas an up-and-down movement of the package 5 during the heating period had the effect in principle of the temperature being evened out between its top and bottom layer.

Figure 2:
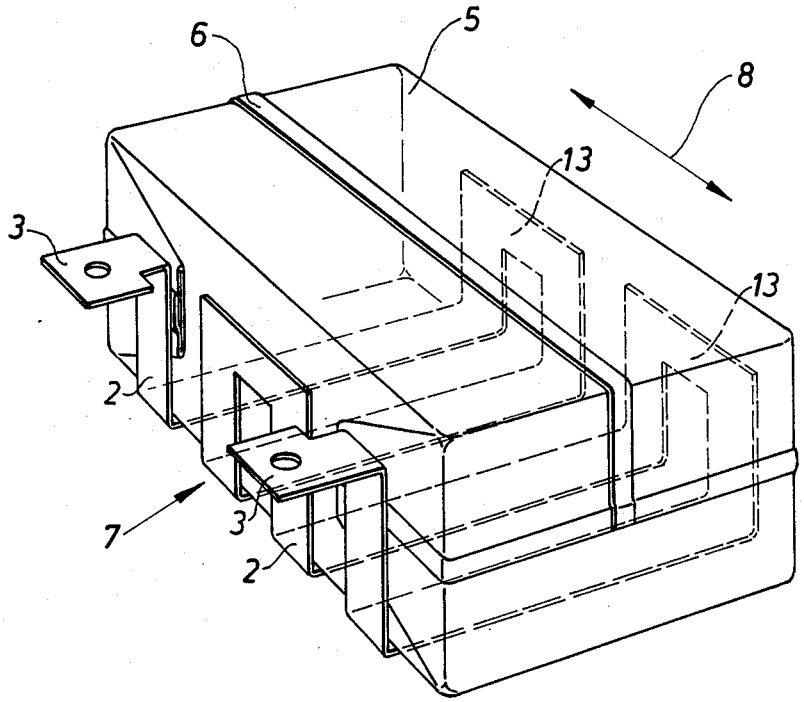
FIG. 2 is a perspective view of a heating arrangement constructed in dishlike form manufactured from coherent U-shaped elements.
Figure 2A:
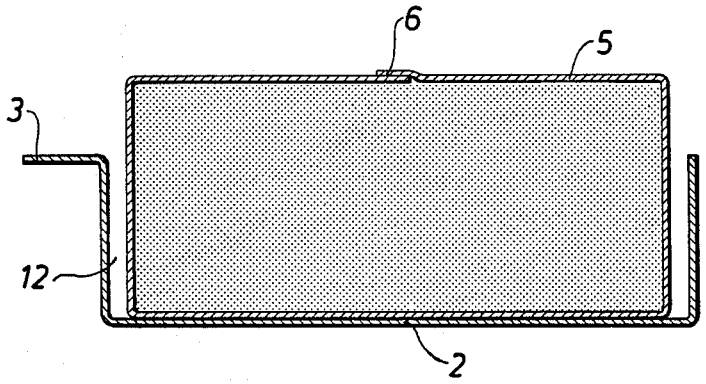
FIG. 2*a* is a sectional view through the arrangement in accordance with FIG. 2.

In order to overcome the great temperature diferences obtained between the bottom layer and top layer of a stationary package 5 an inductor in accordance with FIG. 2 is provided instead. This inductor which is designated by numeral 7 forms a channel or a shell which encloses the package 5 only to one half. The inductor continues to be manufactured of punched-out U-shaped elements 13 of copper but, as is evident from FIG. 2, the introduction of the package 5 is simpler, since the package only needs to be laid down into inductor 7. As is evident from FIG. 2*a* the package is located so that its longitudinal joint 6 faces upwards and is not embraced therefore by the magnetic field which is generated by the inductor 7. By arranging the inductor 7 in this manner of course not all wall surfaces of the package 5 are utilized for induction of heat-generating induction currents but, since the package 5 lies on its side, the distance between the lower and upper part of the package as it lies in the inductor 7 is smaller so that a better heat distribution might be expected in stationary arrangement. This proved to be the case in fact but the heat distribution could be improved further by imparting a reciprocating movement to the arrangement in the direction shown by the arrows 8. By means of a continuous to and fro movement during the course of the heating the temperature difference between the lower and upper layer could be reduced to less than 3° C. the movement is achieved with the help of an eccentric arrangement with a reciprocating harmonic motion of a frequency of approx. 1 Hz. Practical experiments show that with an inductor 7 according to FIG. 2 a heating from approx. 20°–60° C. can be obtained in between 35 and 45 seconds at an energy input of between 1 and 1.5 kW. It is found that the inductor 7 itself becomes so warm that it requires a certain amount of cooling by means of a fan.

Figure 3:
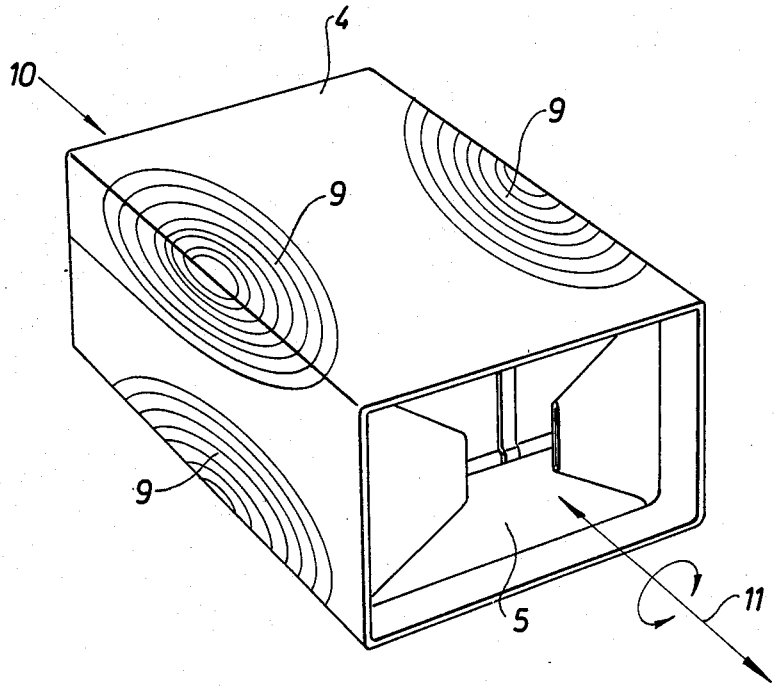
FIG. 3 is a perspective view of a heating arrangement comprising pancake coils arranged on a shell.
Figure 3A:
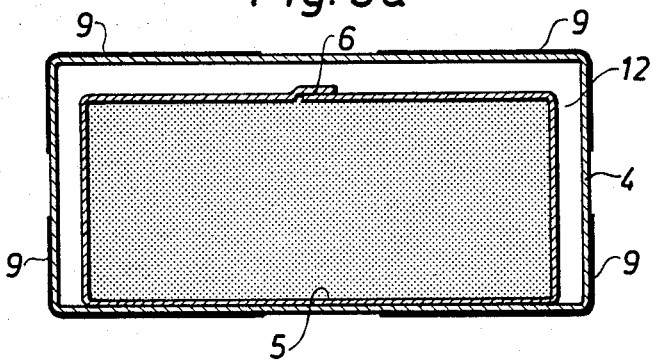
FIG. 3*a* is a sectional view through the arrangement in accordance with FIG. 3.

A third inductor 10 of a somewhat different type has also been tried and this inductor is shown in FIG. 3. The inductor 10 in accordance with FIG. 3 consists of 4 off pancake coils 9 which are wound from multicore conductors and are arranged on an electrically insulating shell 4 in such a manner that the pancake coils 9 will be folded over the longitudinal edges of the shell and thus enclose at the same time parts of two adjoining sides of the shell 4. This design has the advantage, among other things, that the package 5 introduced into the inductor 10 can be turned in optional direction without the longitudinal joint 6 coming within a region where induction currents are generated. This inductor 10 too gives good heating results with good heat distribution if the inductor is moved in the manner indicated by the arrows 11 slightly to and fro as well as rotated forwards and backwards over 90° C. around a horizontal axis with a periodicity of one rotation per second. One effect which was detected was that the distribution of current in the aluminium foil layer became more uneven on using pancake coils 9 than in the previous case where coils are used which had been punched out from a copper sheet to form plane-parallel conductors. This disadvantage can be overcome, however, by arranging the coil turns in the pancake coil 9 so that they are denser at the outer edge of the coil but are arranged with greater distances between each other farther in towards the coil centre. In such a manner a relatively even distribution of current can be obtained in the aluminium foil layer and a heating of the contents from 20° to 56° C. can be achieved in 45 seconds with a power input of approx. 1 kW. To achieve a uniform distribution of heat in the heated, packed beverage it thus seems appropriate to impart some form of motion to the package 5 during the course of the heating so that a circulation of the beverage is achieved.

Figure 4:
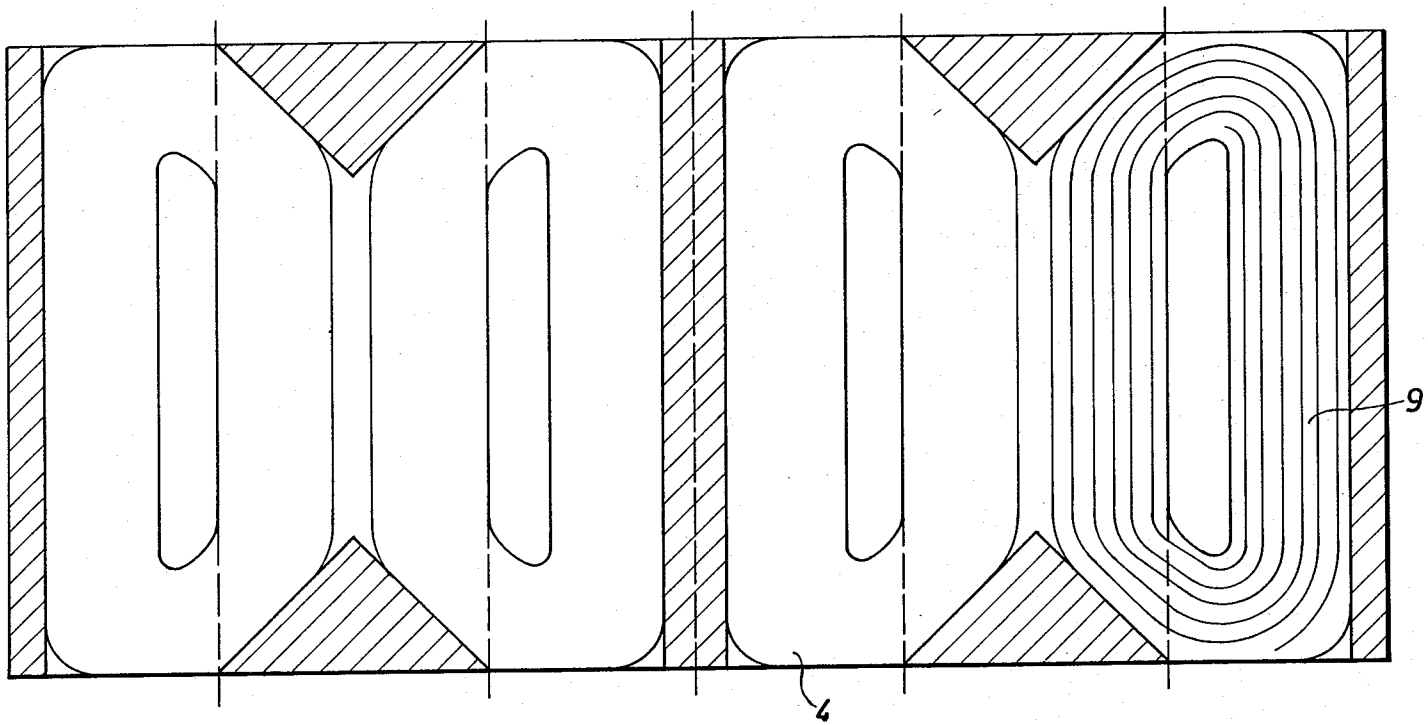
FIG. 4 is a plan view of the arrangement in accordance with FIG. 3 expanded in a plane.

The inductor 10 in accordance with the FIG. 3 has the further advantage that the four pancake coils 9 can be mutually coupled together in such a manner that they provide an impedance which makes it possible to operate without any adapter transformer between generator and inductor. FIG. 4 shows an inductor in accordance with FIG. 3 in expanded condition where the hatched portions correspond to the parts in which no currents may be induced in a packing container introduced into the inductor. As is evident the pancake coils 9 can be designed easily in such a manner that certain parts, e.g. the triangular lugs of the package are kept away from the effect of the magnetic field and this causes the inductor 10 in accordance with FIG. 3 to be preferred in many cases over the inductors 1 and 7 shown in FIGS. 1 and 2. Thus the pancake coils 9 can be wound in such a manner that the surface they cover can be selected with great freedom and it is possible, moreover, to adjust the distance between coil turns in such a manner that the distribution of the inductioin currents can be controlled.

With a heating arrangement in accordance with the invention which, as has been shown, may be in a variety of forms it is thus possible to heat a beverage enclosed in a packing container 5 from 20° to 60° C. in less than 45 seconds without thereby any changes being produced in the taste of the beverage. It will be difficult, however, without simultaneous mechanical movement of the packing container 5 and preferably also the inductor, to obtain a uniform distribution of heat in the beverage within the package. It may be anticipated, of course, that the consumer of the package after the instant of purchase will shake the package and that thereby the temperature differences in the beverage inside the package will quickly even out, but this does not solve the whole problem, since a heating without mechanical movement produces local overheatings whcih may damage the beverage, and it has been considered appropriate, therefore, to combine the heating with a mechanical movement so that a uniform heat distribution in the beverage is obtained without local overheating occurring on any occasion.

It has been found that the inductor arrangement can be made so small that it can be readily accommodated in an automatic vending machine. Naturally a device is also required for bringing about the mechanical movement so as to obtain circulation of the beverage, but it has been found that this can be achieved very simply with the help of an eccentric arm coupled to a motor. A high-frequency generator is also needed, of course, which requires a certain space and which entails a certain cost. However, this high-frequency generator may be placed in an arbitrary location in the vending machine so that the need for such a generator in most cases does not represent a problem, not even in the reconstruction of older vending machines when these are to be modernized for the distribution of warm drinks.

At the instant of a sale, after the necessary coin has been inserted, the package thus will not be made directly available to the purchaser but instead the package will be fed down into an inductor of an appearance in accordance with anyone of the design forms specified here, whereupon the inductor is connected to a high-frequency power source at the same time as a mechanical device will rotate and/or move the inductor and the package to and fro so as to achieve circulation of the packed beverage. After connection to a power source a high-frequency electromagnetic field will induce induction currents in the aluminium foil layer of the package which is heated rapidly along the parts where paths of current are induced. Since only a thin thermoplastic layer separates the aluminium foil layer from the beverage the heat will be transferred rapidly to the beverage which is thus given a consumption temperature of approx. 60° C. in approx. 30 to 45 seconds. After the heating operation the packing container is automatically withdrawn from the inductor and is made available to the buyer.

It is, of course, possible to embody the invention in other specific forms than those of the preferred embodiment described above. This may be done without departing from the essence of the invention. The preferred embodiment is merely illustrative and should not be considered restrictive in any way. The scope of the invention is embodied in the appended claims rather than in the preceding description and all variations and changes which fall within the range of the claims are intended to be embraced therein.

What is claimed is:

1. Apparatus for heating the liquid contents of packing containers, said apparatus employing a high freuqency electromagnetic field and comprising:

an electrically insulating shell to receive packing containers therein, said insulating shell being arranged to allow displacement of a packing container along a predetermined path;

means for feeding a packing container of the type having a layer of metal foil and a joint extending along a region of overlap of the layer of metal foil into said electrically insulating shell with said region of overlap being substantially parallel with said path; and an electromagnetic induction coil mounted on a portion of the exterior of said shell to produce an electromagnetic field in the interior of said shell along said path, said coil having coil segments spaced apart from each other along said shell to define a region extending parallel to said path and positioned to be aligned with the region of overlap of packing containers received in said electrically insulating shell;

whereby when a high frequency generator is connected to said induction coil any container in said shell will be heated without overheating the region of overlap.

2. The heating apparatus according to claim 1 wherein the interior of said shell is of parallelepipedic shape.

3. The heating apparatus according to claim 1, wherein said coil is constituted of coil segments punched out from a sheet, said coil segments having a number of successive, U-shaped, coherent sections.

4. The heating apparatus according to claim 1, including movement imparting means for moving the packing container within said shell to cause the contents of the packing container to be stirred up during the course of heating.

5. The heating apparatus according to claim 4 wherein said movement imparting means rotates the electrically insulating shell and the electromagnetic induction coil periodically between a horizontal and a vertical position during the course of the heating.

* * * * *